US005362209A

United States Patent [19]

Day

[11] Patent Number: 5,362,209

[45] Date of Patent: Nov. 8, 1994

[54] PROPORTIONAL SOLENOID ACTUATOR AND PUMP SYSTEM INCLUDING SAME

[75] Inventor: Eric Day, Longmeadow, Mass.

[73] Assignee: AIL Corporation, Columbia, S.C.

[21] Appl. No.: 704,921

[22] Filed: May 23, 1991

Related U.S. Application Data

[63] Continuation-in-part of Ser. No. 683,438, Apr. 10, 1991, Pat. No. 5,138,291.

[51] Int. Cl.[5] ..... F04B 49/06; F02M 59/34

[52] U.S. Cl. ..... 417/293; 123/357

[58] Field of Search ..... 123/357, 458, 450, 373; 417/218, 293

[56] References Cited

U.S. PATENT DOCUMENTS

| | | | |
|---|---|---|---|
| 1,668,752 | 5/1928 | Anderson . | |
| 2,523,660 | 9/1950 | Hulstein . | |
| 2,895,089 | 7/1959 | Leber . | |
| 2,933,571 | 4/1960 | Howell . | |
| 3,210,616 | 10/1962 | Severn . | |
| 3,489,092 | 1/1970 | Thomson | 123/450 X |
| 3,787,791 | 1/1974 | Borger et al. . | |
| 4,036,193 | 7/1977 | Kobayashi | 123/357 X |
| 4,037,574 | 7/1977 | Swift | 123/502 |
| 4,114,125 | 9/1978 | Komatsu . | |
| 4,150,351 | 4/1979 | Berg . | |
| 4,177,440 | 12/1979 | Merlette . | |
| 4,212,279 | 7/1980 | Ohtani | 123/357 |
| 4,218,669 | 8/1980 | Hitchcock et al. . | |
| 4,425,889 | 1/1984 | Hachitani et al. | 123/357 |
| 4,463,332 | 7/1984 | Everett . | |
| 4,541,392 | 9/1985 | Ogino | 123/357 |
| 4,550,702 | 11/1985 | Djordjevic | 123/450 |
| 4,583,067 | 4/1986 | Hara . | |
| 4,604,980 | 8/1986 | LeBlanc | 123/450 |
| 4,812,884 | 3/1989 | Mohler . | |
| 4,862,853 | 9/1989 | Tsukamoto | 123/357 |

FOREIGN PATENT DOCUMENTS

| | | | |
|---|---|---|---|
| 72634 | 4/1983 | Japan | 123/357 |

OTHER PUBLICATIONS

D. R. Hardwick, Hydraulics & Pneumatics, Aug. 1984 entitled "Understanding Proportional Solenoids".

*Primary Examiner*—Leonard E. Smith
*Attorney, Agent, or Firm*—Synnestvedt & Lechner

[57] ABSTRACT

An actuator for moving a solenoid armature to control fuel in response to a control current is built into a fuel pump, with trapped air in and around the actuator preventing contamination of the actuator by ferromagnetic particles in the liquid fuel from the fuel pump.

2 Claims, 6 Drawing Sheets

PROPORTIONAL SOLENOID ACTUATOR AND PUMP SYSTEM INCLUDING SAME

This application is a continuation-in-part of Ser. No. 07/683,438, filed Apr. 10, 1991, and now U.S. Pat. No. 5,138,291.

FIELD OF THE INVENTION

This invention relates to solenoid actuators of the type which utilize a solenoid coil and a plunger movable within the coil and along its axis, the plunger being capable of assuming any of a substantial range of stationary positions as determined by the value of the current through the solenoid. It particularly relates to actuators which are linear rather than rotary, and which are designated as "proportional" actuators, not because the position of the plunger is necessarily exactly proportional to the coil current but because it is usefully close to being proportional. It also relates to a pump system incorporating an actuator within the pump itself.

BACKGROUND OF THE INVENTION

Solenoid actuators have long been known in which a plunger is mounted to slide axially along the center of a solenoid in response to current in the solenoid; such devices may be embodied in electrical relays or in valve controls, using a spring which holds the plunger in one extreme position yet permits it to be switched or moved instantaneously to its alternate stable position by current in the solenoid.

The present invention preferably uses a different class of solenoid actuators, commonly designated as "proportional" solenoid actuators, in which the plunger can be controlled to assume any of a range of stationary positions depending upon the magnitude of the current supplied to the actuator coil. Such actuators find particular use in controlling the position of the fuel supply control for an engine, which is to be closely controlled in response to an electric current.

One specific application of such actuators is in connection with engines designed to drive electrical generator sets, in which the speed of operation is intended to be controlled so as to remain constant despite changes in load and other parameters. In such arrangements the proportional solenoid actuator is normally part of a feedback system in which the speed of the engine or generator is sensed, compared with the desired standard, and if the speed departs from the standard, the current in the solenoid coil is changed to reposition the plunger in the solenoid in the direction and magnitude to correct the discrepancy in engine speed.

The general arrangement of such a system involves use of a spring which tends to move the plunger in a direction opposite to the direction in which the solenoid current tends to move it. For example, where the actuator is used to control fuel supply, the spring normally biases the plunger in the direction of reduced fuel supply, and the current through the solenoid coil tends to move the plunger in the direction of increased fuel supply. With appropriate selection of spring and actuator configuration, the force due to the solenoid current and the force due to the biasing spring will be equal at some position of the plunger, and the plunger will then assume that position; increases or decreases in the solenoid current will move the plunger on either side of the latter position, as necessary to achieve the fuel control intended.

An article by D. R. Hardwick appearing in the Aug. 1984 "Hydraulics and Pneumatics" discusses such proportional solenoids in a general manner. As mentioned in the latter article, the normal non-proportional solenoid actuator ordinarily uses a variable air gap in series in the magnetic path; that is, when the plunger is in one position it is spaced widely from a pole piece and there is a wide gap in the flux path, resulting in a low attractive force on the plunger, but as the plunger advances toward the associated pole piece the air gap decreases and the force exerted on the plunger by the solenoid coil increases rapidly. The result is basically what one feels when one holds the north pole of one magnet near the south pole of another; when they are a substantial distance apart there is very little interaction, but when they are moved close to each other a sudden drastic increase in attractive force occurs which snaps them together. Such devices have sometimes been called snap action or on/off actuators, and are useful in relays and the like.

In contrast, what is desired in a proportional actuator is a characteristic according to which, for a fixed current in the actuator coil, the force exerted on the actuator plunger by the magnitude flux of the solenoid remains nearly constant over a substantial useful working range. These considerations are outlined in a very general discussion in connection with FIG. 2 of the above-referenced Harwick article. However, that article does not disclose clearly any particular configuration of actuator for achieving this result, and in any event does not show or suggest that which is the subject of the present invention.

It is also known, in certain rather unrelated types of solenoid actuators, to support the forward end of the magnetic plunger by a small-diameter magnetic extension thereof which can slide in an appropriate bushing or bearing at the confronting end of the solenoid, so as to provide appropriate support. It is also known to provide a conical taper on the leading end of the ferromagnetic portion of the plunger; this is done in some cases apparently to increase the range of linearity of the actuator, i.e. increase the range over which the force exerted by the solenoid on the plunger is nearly constant for different plunger positions. However, the characteristics of such actuators, and particularly the range for which a nearly constant force is exerted on the plunger by the solenoid coil, are still not as effective as is desirable.

It is also known to incorporate an actuator within a fuel pump casing, but since the casing is normally filled with fuel the actuator is also in contact with the fuel, which may contain foreign material tending to harm the performance of the actuator, e.g. small particles of ferromagnetic material.

An object of the present invention is to provide a novel combination of a solenoid actuator within a diesel fuel pump, so constructed as to prevent fuel in the pump from contacting the actuator.

SUMMARY OF THE INVENTION

These and other object of the invention are achieved by the provision of a solenoid actuator mounted in a cavity in the top of the casing of a pump, with the solenoid armature operating the fuel-control linkage. The cavity traps air between the actuator and the top of the fuel in the pump to prevent fuel from rising into the actuator to contaminate it and harm its performance.

BRIEF DESCRIPTION OF FIGURES

These and other objects and features of the invention will be more readily understood from a consideration of the following detailed description, taken with the accompanying drawings, in which.

DETAILED DESCRIPTION OF PREFERRED EMBODIMENTS

Figure 1:
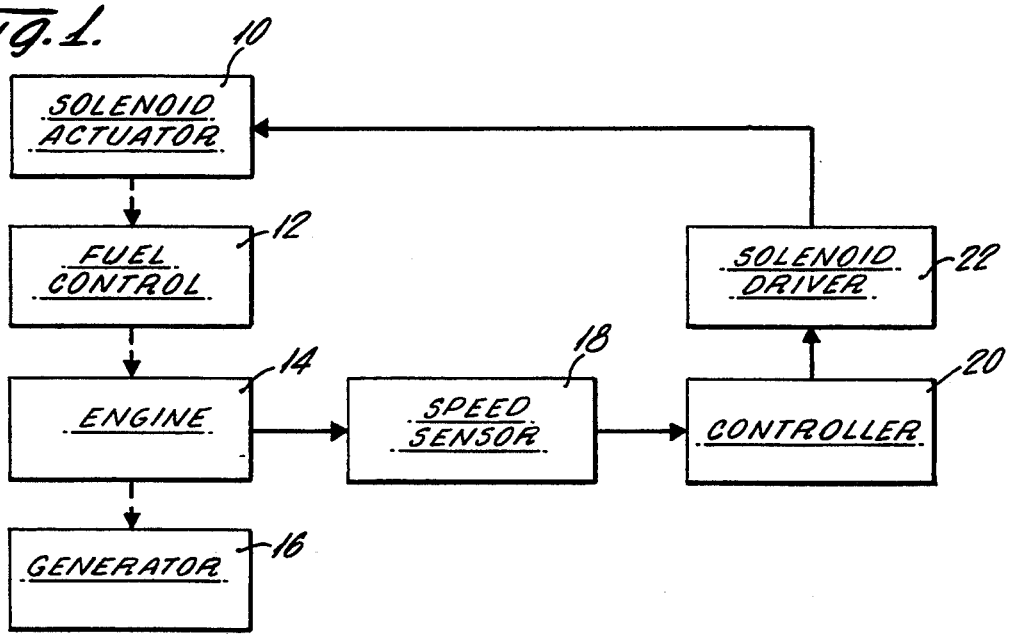
FIG. 1 is a schematic diagram, largely in block form, illustrating a control system in which the invention is usefully and advantageously employed.

Referring now specifically to FIG. 1, a solenoid actuator 10 is shown in a system for operating a fuel control 12 of an engine 14, such as a diesel engine for example, which in turn may be utilized to drive an electrical generator 16. Known speed sensor 18 of conventional form is used to measure engine speed, and the speed-representing signals thus derived are supplied to a controller 20, which may be a microprocessor or an analog device, as examples. The controller 20 senses departures of the speed of the engine from a desired preset value, and varies the electrical control current supplied through a conventional solenoid driver 22 to the coil of the solenoid actuator 10 in a magnitude and sense to reduce departures of the engine speed from the desired value.

Referring now especially to FIGS. 2–7, the preferred embodiment of the actuator is shown in more detail. An outer cylindrical casing 30 of magnetic mild steel contains a solenoid coil 32 wound on a non-magnetic cylindrical support piece 34, which may be made of brass or plastic material. A pair of end plates 36 and 38 are provided which fit tightly within the outer casing 30 at each end of the solenoid coil, serving as pole pieces, and to this end are themselves made of magnetic material such as mild steel; the end pieces also serve to hold the solenoid coil in position. Each of the end pieces has an outer annular flange such as 40 which fits tightly in and against the inner surface of the outer casing 30, and each has an inner annular flange such as 42 as well. These inner flanges serve to support the magnetic armature or plunger assembly 44 for axial sliding motion within the solenoid; cylindrical plastic bearings 46 and 48 are preferably used in the end pieces to provide suitable low-friction sliding support for the forward and rearward portions of the plunger assembly.

Figure 2:
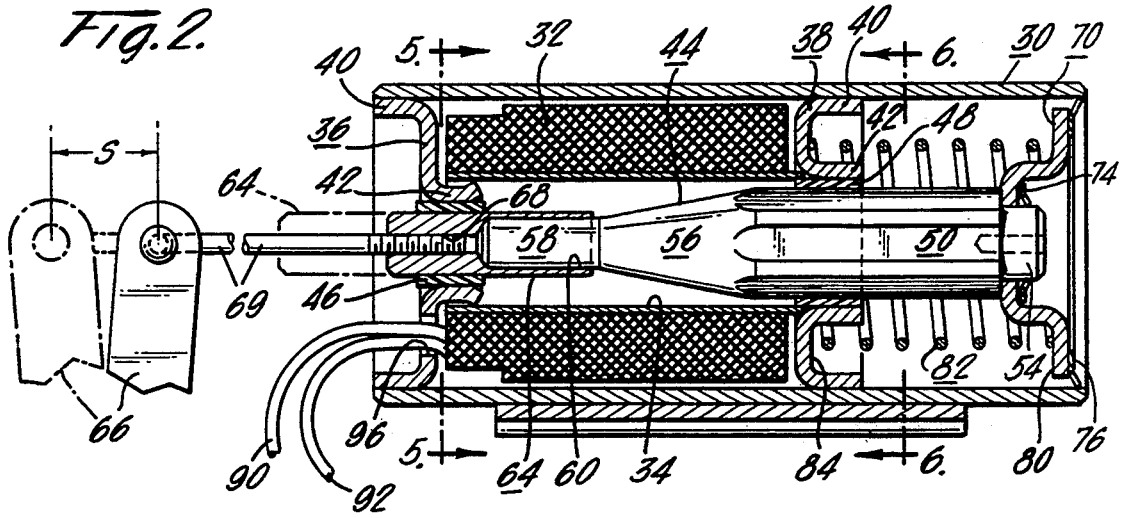
FIG. 2 is a sectional side elevational view of the actuator.
Figure 3:
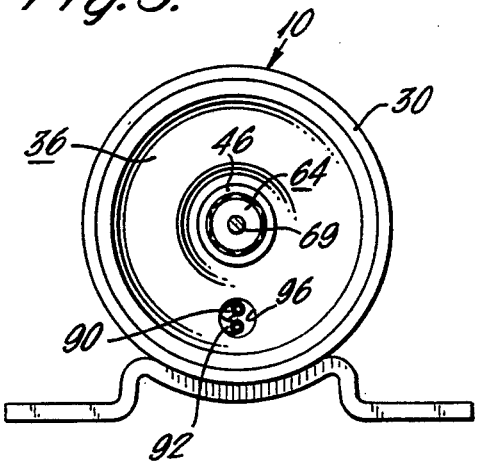
FIGS. 3 and 4 are right and left end elevational views of the device as shown in FIG. 2.
Figure 4:
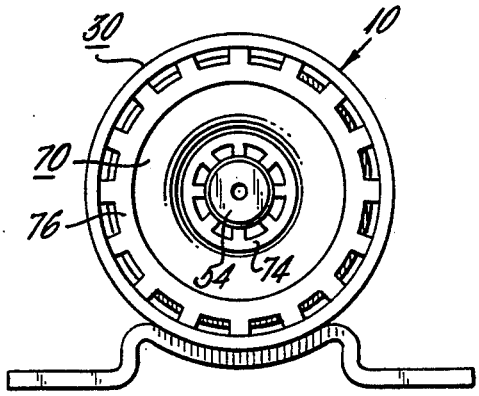
Figure 5:
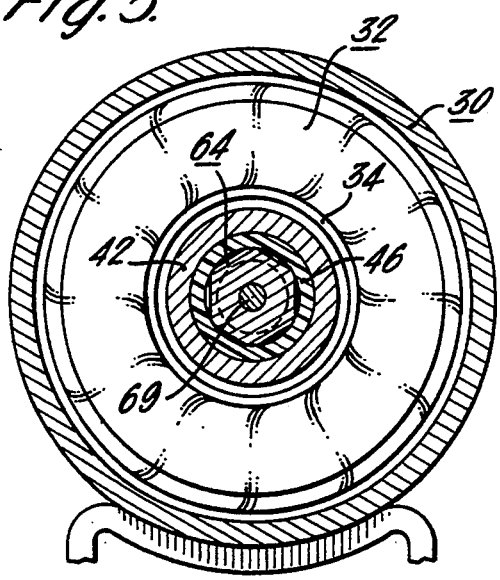
FIG. 5 is a vertical sectional view taken along lines 5—5 of FIG. 2.
Figure 6:
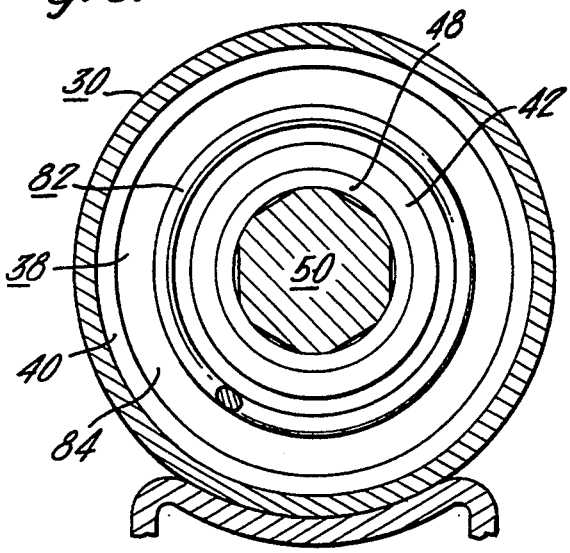
FIG. 6 is a vertical sectional view taken along lines 6—6 of FIG. 2.
Figure 7:
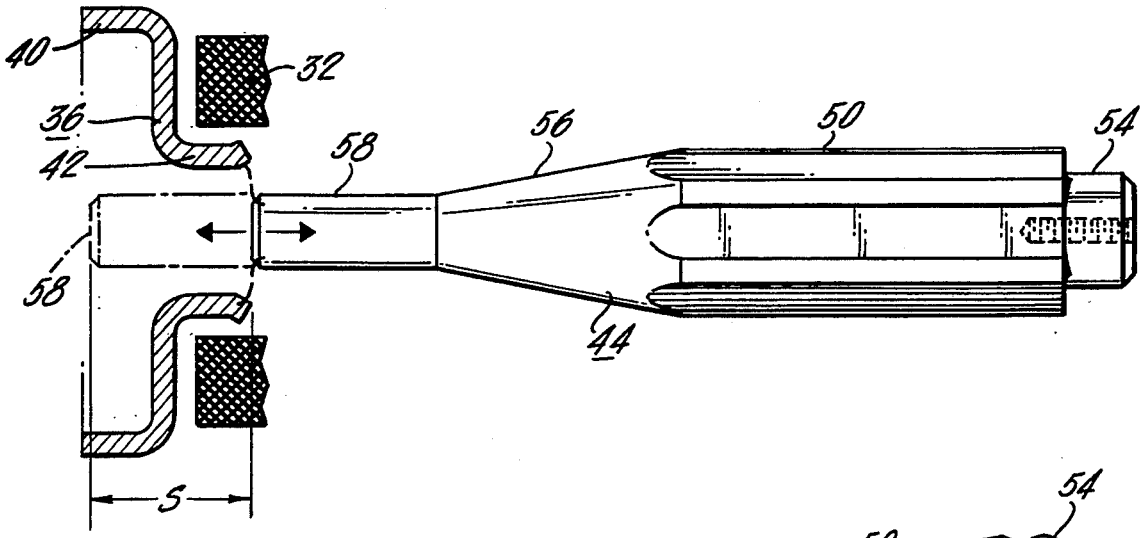
FIG. 7 is a fragmentary side elevational view of a portion of the armature and front bearing of the device shown in FIG. 2, with the non-magnetic front extension 64 removed for clarity and an advanced position of the plunger assembly shown in broken line.
Figure 7A:
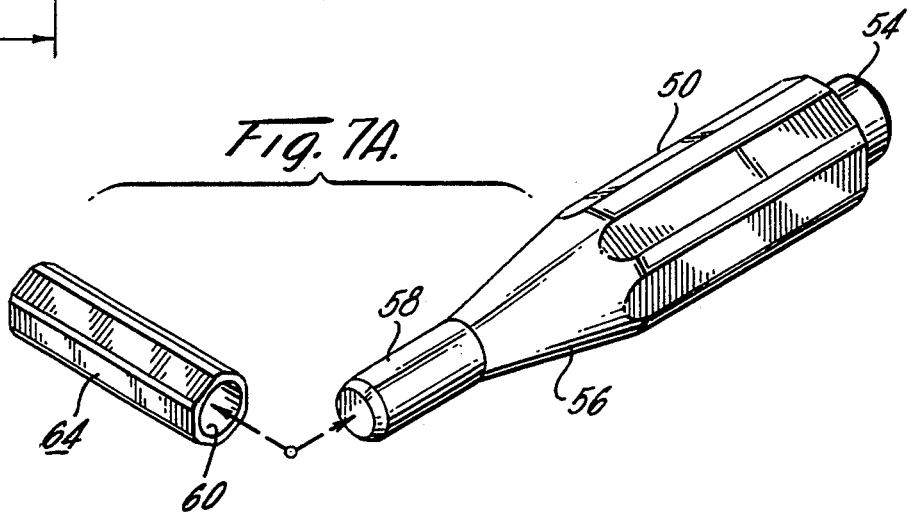
FIG. 7A is an exploded perspective view of the armature assembly with the non-magnetic extension removed.

In the following, the portion of the plunger assembly positioned near the right end of the actuator as shown in FIG. 2 will be designated as the rearward end, and the opposite end near the left end of the actuator will be designated as the forward end of the plunger assembly, as a convenience in description. The plunger assembly in this case has a larger diameter portion 50 of approximately hexagonal cross-section, the edges of the hexagonal surfaces being somewhat rounded to slide easily within the PTFE-type bearing 48 without scoring it. At the right of this hexagonal larger-diameter portion of the plunger is a unitary cylindrical shaft 54 which may be used as the output shaft in some cases, if desired.

Extending forwardly from the larger-diameter portion of plunger assembly 44 is a magnetic frusto-conical portion 56 from which a magnetic cylindrical extension 58, in turn, extends forwardly. The latter cylindrical extension is magnetic, and fits into and is bonded in a coaxial opening 60 in the adjacent end of the non-magnetic forwardmost portion 64 of the plunger assembly; this forwardmost portion 64 may be of stainless steel for example, with a polygonal (e.g. hexagonal) cross-section, for sliding axially in the cylindrical PFTE-type bearing 46, again with its edges rounded to avoid scoring. This non-magnetic end portion of the plunger assembly may be used to operate or actuate a fuel control lever 66, for example; it contains a threaded central bore 68 which provides a convenient means of attachment of a threaded control rod, such as bicycle spoke 69, for connection to the fuel control lever. A similar bore may be provided at the other end of the plunger and may be used in a similar manner in some cases.

Rearward of the large diameter section 50 of the plunger assembly is a spring retainer plate 70, which is centrally apertured to slide over shaft 54 until it abuts against the shoulder formed by the larger-diameter portion 50 of the plunger assembly. It is held in this position by a first retaining ring 74, as shown. Rearward motion (to the right in FIG. 2) of the spring retaining plate is preferably limited by another retaining ring 76, which fits tightly against the inside of outer casing 30. The spring retainer plate is generally cup-shaped, the outer portion of the peripheral flange 80 thereof serving to retain one end of the biasing spring 82, which is in the form of a coil spring the other end of which bears against the bottom of the channel 84 in end piece 38. Since the latter end piece is fixed in position by its tight fit against the inner surface of the casing 30, the spring 82 serves to urge spring retainer plate 70 outwardly or to the right in FIG. 2, moving with it the entire plunger assembly.

During operation then, the complete plunger assembly is slidingly supported in end plate 38 at its larger end, and in end piece 36 at its forward end, where the non-magnetic extension 64 extends through the front bearing 46 of low-friction plastic material, which may be a PTFE-type sleeve bearing. The plunger assembly is therefore mounted for easy, low friction and low sticton, axial sliding motion; it is biased rearwardly, or toward the right, by the spring, and when current is passed through the solenoid coil, the resultant magnetic field tends to move the plunger to the left against the biasing force of the spring. The electrical leads 90,92 from the two opposite ends of the solenoid coil may be brought out through an opening 96 in the end piece 36, for connection to the solenoid drive circuits. To prevent dirt from entering the interior of the actuator, bellows may be employed at each end.

Figure 8:
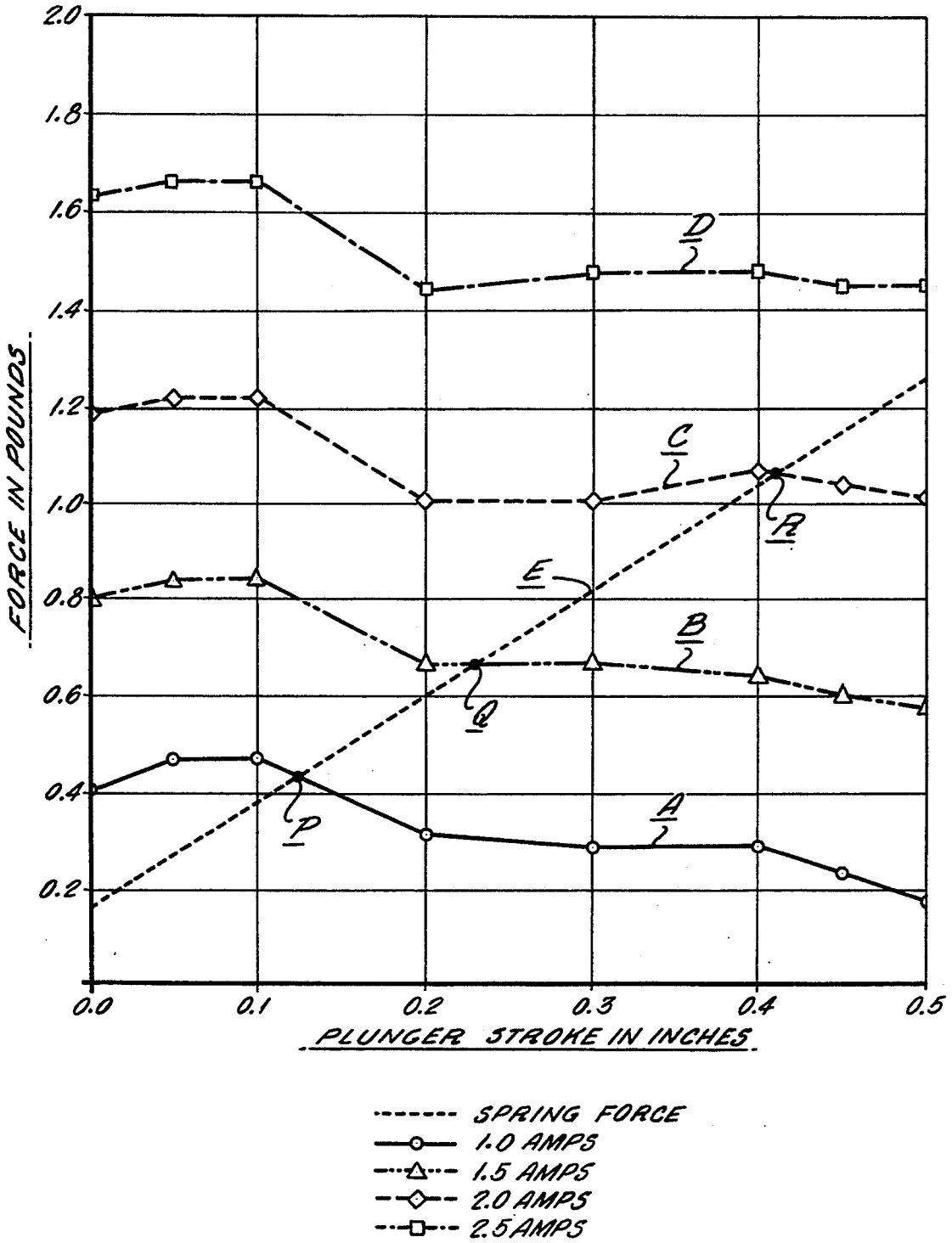
FIG. 8 is graphical representation showing the effects of different solenoid currents on the position of the armature assembly.

FIG. 8 shows typical electrical characteristics and spring characteristics preferably employed in a preferred embodiment of the invention. In this figure, ordinates represent the force in pounds exerted upon the plunger assembly along the axial direction (to the left) by the magnetic flux of the solenoid, and abscissae represent the plunger assembly position in inches, where 0 represents the position of the plunger when it is in its extreme rightward position in FIG. 2, against the retaining ring 76, and 0.5 represents the position of the plunger when it is moved to an extreme leftward position in FIG. 2. The curves A, B, C and D show a plot of the force exerted by the solenoid versus plunger position for solenoid currents of 1.0, 1.5, 2.0 and 2.5 amperes, respectively. The straight line E, plotted on the same figure, shows the biasing force exerted on the plunger by the spring 82, tending to move the plunger toward its rightmost position in FIG. 2, for various plunger positions as shown. The spring force tending to move the plunger to the right equals the spring force exerted by the solenoid tending to move the plunger to the left at those points where the straight line characteristic E intersects the other curves. Thus, in this example, applying the solenoid currents 1.0, 1.5, 2.0 and 2.5 amperes causes the plunger to position itself at plunger positions corresponding to intersection points P, Q, and R, respectively. These changes in position of the plunger, while not exactly proportional to the solenoid current, are sufficiently so to provide good control action over the range shown. The graphs of FIG. 8 are applicable to a plunger assembly in which the larger-diameter hexagonal part 50 is about ½ inch in diameter and about 1.17 inch long, the tapered portion is about ¾" long, tapering to match the diameter of the cylindrical extension 58, which is about ¼" in diameter.

Figure 9:
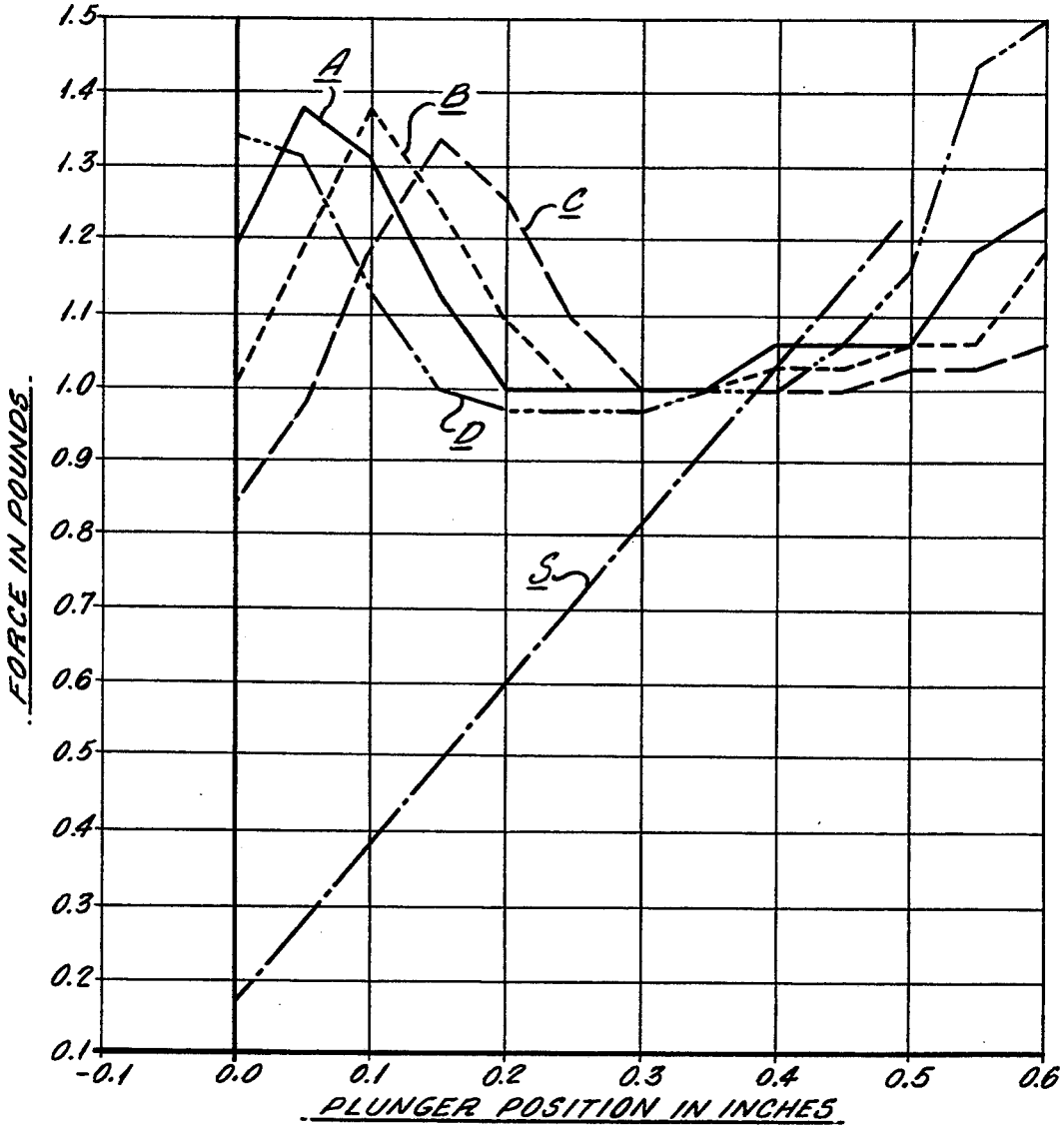
FIG. 9 is a graphical representation illustrating the effects of changes in the length of the magnetic front extension of the armature assembly.

FIG. 9 illustrates the typical effects of changes in the length the of cylindrical magnetic extension 58. In FIG. 9, ordinates represent force exerted on the plunger assembly by the solenoid magnetic flux, and abscissae represent the position of the plunger assembly, with 0.0 representing the position of the plunger assembly when its rightward motion is arrested by retaining ring 76. These graphs are applicable to a plunger assembly in which the hexagonal larger-diameter portion is about 0.5 inch in diameter and about 1.1 inches long, and the tapered conical portion is about ¾ inch in length, reducing to about the diameter of the magnetic extension, which in this case is about ¼".

Graph A illustrates the solenoid force characteristic obtained when the extension 58 is about 0.55 inches long and about 0.25" in diameter.

Curve B shows the solenoid force characteristic for an extension which is about 0.05" shorter than for graph A. The others graphs C and D show the solenoid force characteristics for lengths of extension 58 which are 0.10" shorter and 0.05" longer, respectively, than for graph A.

Plotted on the same graph there is a suitable spring biasing load line S.

For each of graphs A–D of FIG. 9, the dimensions of the actuator are such that the left-hand end of the magnetic extension 58 travels between a position slightly interior of the end pieces 36 to a position outside the end piece. In this example, the preferred operating range is from about 0.15" to about 0.5", using the characteristic of graph A.

In general, for use in a feedback system it is desirable that the angle which the spring load line makes with the solenoid force characteristic be relatively large. To achieve this, a nearly constant force over the length of the plunger stroke is desirable for any magnitude of current flow in the solenoid. The dimension of the parts of the plunger assembly may be adjusted as desired to suit any particular application of the invention.

Figure 10:
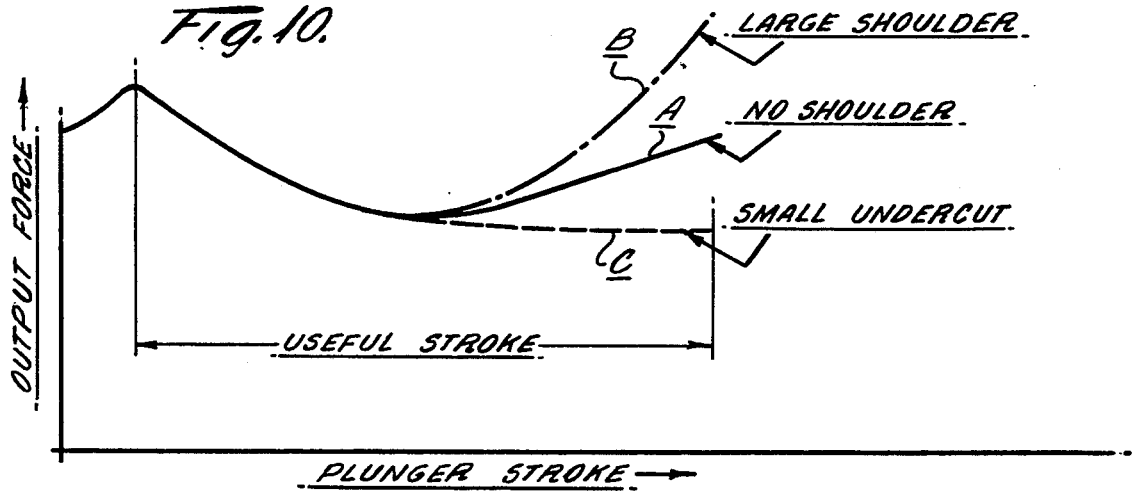
FIG. 10 is a graphical representation showing the effect of using different front end diameters for the conical portion of the armature assembly.

FIG. 10 is a graph which shows the effects of varying the angle of taper and the diameter of the shoulder at the left-hand end of the conical portion of the plunger, as illustrated below the graphs of FIG. 10. Graph A shows the characteristic when there is no shoulder, i.e. diameter of end of conical portion equals the diameter of extension 58; graph B shows the case for a relatively large shoulder, greater in diameter than extension 58, and curve C shows the case for a diameter of shoulder which is slightly less than the diameter of the extension. The latter configuration is the one which provides a nearly linear horizontal curve over the greatest range of plunger positions, and is therefore preferred, for certain applications.

FIG. 2 shows by the broken lines the preferred range for the stroke of the plunger with respect to the forward or leftmost edge of the magnetic extension 58. It will be seen that the plunger preferably operates over a range in which this forward edge moves from a position where it is flush with or just interior of the left end piece, through positions within the end piece, and beyond. When the end of the magnetic extension 58 is inside the end piece, the magnetic flux magnitude is dominated by the radial "air" gap between extension 58 and end piece 40. Thus the magnet flux is held approximately constant irrespective of the position of the plunger.

Accordingly, there has been provided a new and useful solenoid actuator of the linear motion type, which has the characteristic of a nearly constant force over a relatively wide range of plunger positions, and a consequent nearly proportional repositioning of the plunger in response to changes in the solenoid current, and yet is inexpensive to make.

FIGS. 11–15 illustrate a special combination of a linear actuator in a diesel fuel pump, in a form in which the actuator can be provided as original equipment as a component of the pump, or can be easily installed later on a preexisting pump.

Figure 11:
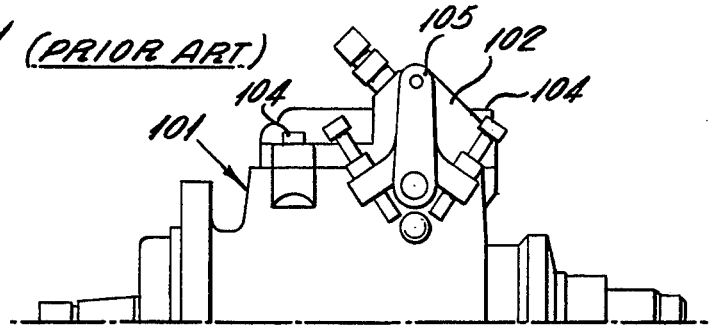
Fig. 11. (PRIOR ART)
FIG. 11 is a partial side elevational view of a commercial diesel fuel pump of the prior art to which the invention may be applied.

FIG. 11 shows the upper half of a commercially available type of diesel fuel pump having an outer casing 101, a top portion 102 of which is readily removable and replaceable by means of bolts, such as 104. The throttle control lever 105 is shown in its normal operating position. The pump may, for example, be a Model DB or DM diesel fuel pump made by Stanadyne Corp of Windsor, Conn.

Figure 12:
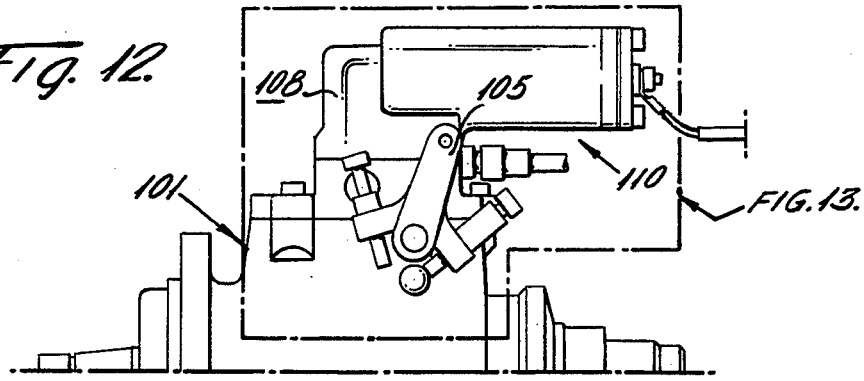
FIG. 12 is a partial side elevational view of the pump of FIG. 11, but with an actuator and top casing portion mounted on it in accordance with the invention in one aspect.

FIG. 12 shows the same pump, but with the upper portion 102 of the casing removed and replaced by a new casing top portion 108 containing the linear actuator 110 in accordance with the invention. In this case the throttle control lever 105 is clamped in its maximum open-throttle position, and the linear actuator controls the fuel delivery instead.

Figure 13:
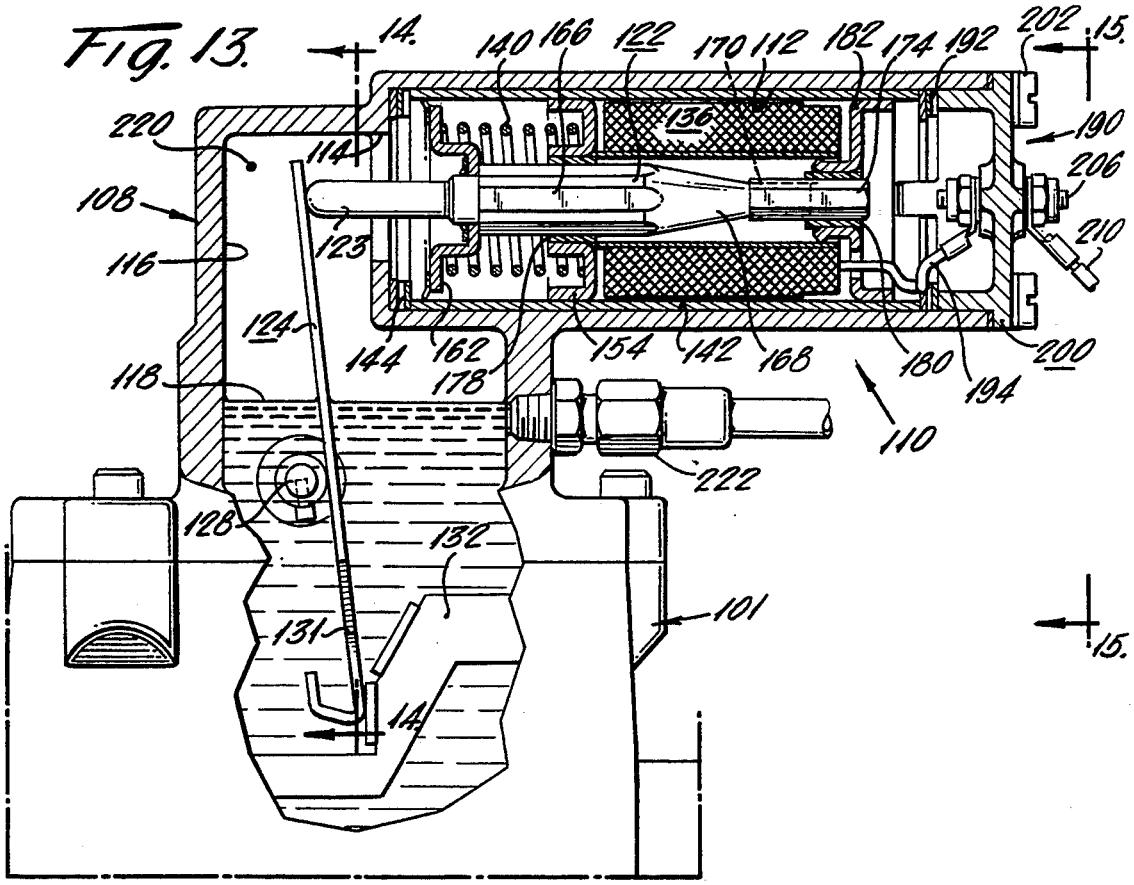
FIG. 13 is a side view, partly in full with parts broken away, and partly in section.
Figure 14:
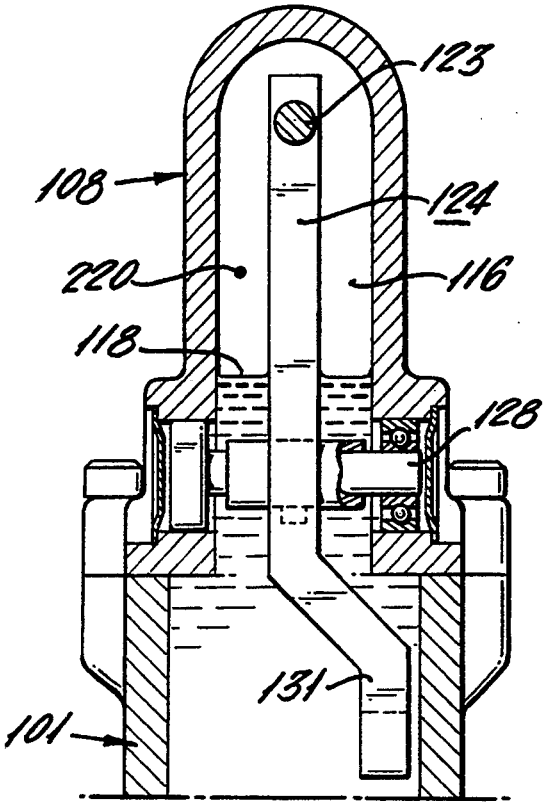
FIG. 14 is a view taken along lines 14—14 of FIG. 13.
Figure 15:
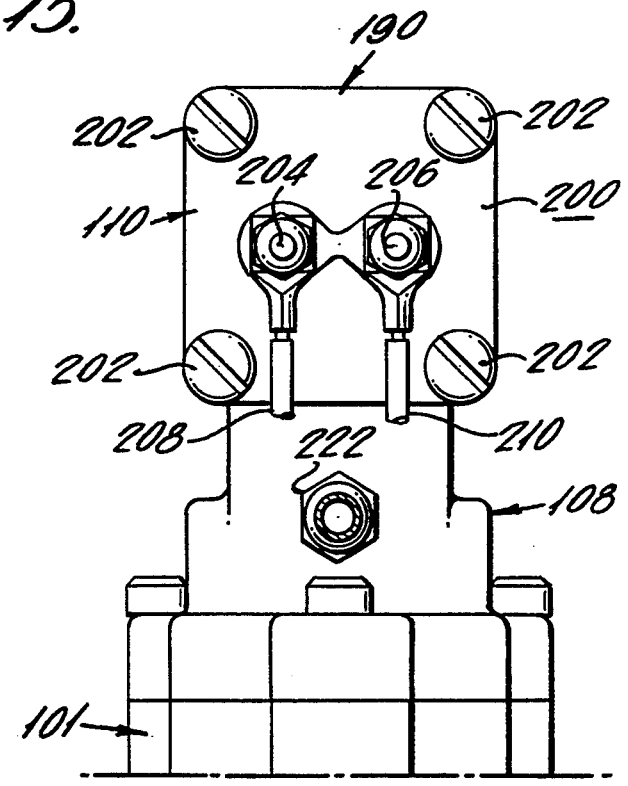
FIG. 15 is a view taken along lines 15—15 of FIG. 13.

The details of the preferred form of casing and linear actuator for this purpose are shown more clearly in FIG. 13–15. The top casing portion 108 is so cast as to contain a tubular cavity 112, one end 114 of which communicates with an empty well 116 extending downwardly to the top surface of the diesel fuel 118 which permeates the interior of the pump.

The linear actuator is preferably similar in most respects to that shown in FIG. 2, with minor differences. It is shown reversed in position from the way it is depicted in FIG. 2, and the larger-diameter end of the plunger 122 is used to support the output actuating rod 123 whose outer end pushes against one end of a connecting lever 124. The connecting lever is supported on a bearing-mounted pivot 128, as by welding, so that when the top end of the connecting lever is pushed to the left in FIG. 13, the lower end 131 of the lever moves to the right and pushes against the conventional fuel control linkage 132, present in the pump as originally manufactured. This motion occurs in response to decreases in current through the actuator solenoid 136; upon increase in solenoid current, the plunger 122 is moved to the right in FIG. 13, the lower end 131 of lever 124 moves to the left, and the fuel control linkage 132 follows it due to the biasing action of a light spring which is part of the pre-existing fuel-linkage system, and not shown. The current in the solenoid 136 is determined by a current controller such as 20 in FIG. 1, to provide constant-speed governor operation, for example.

More particularly, the linear actuator in this example includes an outer steel cylinder 142, the left-hand end of which abuts a positioning shim washer 144. Steel cylinder 142 fits slidingly in tubular cavity 112; the solenoid 136 fits closely within the steel cylinder 142, and a cylinder 145 of plastic or other non-magnetic material fits closely within the solenoid. The fixed spring retainer 154 retains the right-hand end of the spring 140, and the moving spring retainer 162 is fixed to the solenoid plunger 122. This plunger is again preferably of a type having a hexagonal larger-diameter magnetic portion 166, a tapered magnetic portion 168, a protruding magnetic cylindrical portion 170 and a further-protruding hexagonal non-magnetic portion 174. The larger-diameter portion slides in sleeve bearing 178, and the smaller-diameter extension 170 slides in sleeve bearing 180.

The right-hand end of the actuator as depicted in FIG. 13 includes a fixed end piece 182 of magnetic material and an insulating end plug assembly 190. A shim ring 192, provided with holes for passage of the two solenoid leads such as 194, is positioned between the right-hand end of end piece 182 and the left-hand side of plug 200, which fits snugly into the adjacent end of the outer casing 108 and is secured thereto by four screws 202. Mutually insulated feed-through terminals 204 and 206 connect the solenoid leads to the external current-control leads 208 and 210. Cement and/or a sealing gasket is provided between plug 200 and the adjacent end of outer casing 108, to seal it against gas flow, whereby a body of air 220 is trapped in the actuator above the diesel fuel 118 in the pump.

A relief check valve 222 is mounted on the wall of the casing at the level of the top of the fluid 118 in the pump, and is set to release fluid back to tank if its pressure rises above a preselected level, typically 5 psi.

In use, the fuel 118 is prevented from rising into the actuator by the back-pressure of the body of trapped air 220, so that foreign bodies such as small particles of ferromagnetic material in the diesel fluid do not enter the actuator and interfere with its operation.

Accordingly, the actuator is built into the interior of the pump whereby it requires no external mounting space, yet operates free of contamination by the fuel in the pump, and can be assembled easily by merely sliding the successive parts into the outer end of the tubular cavity 112 and then inserting and sealing the plug 200.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. A combination diesel fuel pump and fuel control actuator for said pump comprising:

a fuel pump housing containing said fuel pump and having a cavity at the top thereof, one part of which communicates with the interior of the portion of said housing containing said pump and the remainder of which is air-tight;

a solenoid actuator in said cavity comprising a solenoid and a spring-biased armature movable in said solenoid in response to changes in current in said solenoid;

a fuel-control linkage in said housing for controlling the quantity of fuel delivered by said pump;

connecting means responsive to motion of said armature to operate said fuel-control linkage;

a body of liquid diesel fuel in said housing;

connecting means extending from said armature to said fuel-control linkage and responsive to motion of said armature to move said fuel-control linkage; and a body of trapped air permeating the interior of said cavity and preventing ferromagnetic particles in said diesel fuel oil from contacting the working parts of said actuator.

2. The combination of claim 1, wherein said cavity is tubular and extends horizontally, the top level of said fuel lies below said cavity, and said solenoid actuator is a linear solenoid actuator.

* * * * *